US005676194A

United States Patent [19]

Petry et al.

[11] Patent Number: 5,676,194

[45] Date of Patent: Oct. 14, 1997

[54] INGOT MOULD FOR CONTINUOUS CASTING

[75] Inventors: Rudy Petry, Muensbach; Michel Rinaldi, Steinfort, both of Luxembourg

[73] Assignee: Paul Wurth S.A., Luxembourg, Luxembourg

[21] Appl. No.: 583,030

[22] PCT Filed: Jul. 23, 1994

[86] PCT No.: PCT/EP94/02442

§ 371 Date: Feb. 28, 1996

§ 102(e) Date: Feb. 28, 1996

[87] PCT Pub. No.: WO95/03904

PCT Pub. Date: Feb. 9, 1995

[30] Foreign Application Priority Data

Jul. 30, 1993 [LU] Luxembourg ..... 88 389

[51] Int. Cl.[6] ..... B22D 11/04

[52] U.S. Cl. ..... 164/416; 164/478

[58] Field of Search ..... 164/478, 416, 164/418

[56] References Cited

U.S. PATENT DOCUMENTS 4,483,385 11/1984 Kurzinski ..... 164/416
4,669,525 6/1987 Kurzinski ..... 164/416

FOREIGN PATENT DOCUMENTS 4032333 4/1992 Germany ..... 164/416

*Primary Examiner*—Kuang Y. Lin
*Attorney, Agent, or Firm*—Fishman, Dionne, Cantor & Colburn

[57] ABSTRACT

A description is given of an ingot mould for a continuous casting plant comprising an ingot mould tube (12) and an ingot mould body (22). The ingot mould tube (12) is movable axially with respect to the ingot mould body (22). Sealing elements, preferably metal diaphragms (88, 90) allow an axial displacement of the ingot mould tube (12) with respect to the ingot mould body (22), while ensuring the sealing of a sealed chamber (23) containing the circuit for cooling the ingot mould tube (12). A device for generating mechanical oscillations, preferably a hydraulic cylinder (46), is connected to the ingot mould tube (12) through the intermediary of a lever (54) supported by the ingot mould body (22).

16 Claims, 4 Drawing Sheets

INGOT MOULD FOR CONTINUOUS CASTING

The present invention relates to an ingot mould for a continuous casting plant.

Such an ingot mould for continuous casting comprises an ingot mould tube defining an axial flow channel for a molten metal and an ingot mould body surrounding the ingot mould tube over at least a part of its length. This ingot mould body contains a cooling circuit for the ingot mould body.

In an ingot mould for continuous casting in operation, the ingot mould tube is vigorously cooled by the cooling circuit incorporated in the ingot mould body. In this way, the molten metal solidifies in contact with the inner wall of the ingot mould tube so as to form a peripheral crust. It is to be noted that an attachment or sticking of this solidified peripheral crust to the inner wall of the ingot mould tube would cause the peripheral crust to tear. In order to avoid this risk, it is known that the ingot mould should be subjected to an oscillatory movement along the casting axis.

In order to produce such an oscillatory movement, it is known how to support the ingot mould on a supporting structure, called an oscillating table, which is fitted with a device for generating mechanical oscillations. This oscillating table then transmits to the ingot mould an oscillatory movement directed along the casting axis.

In order to understand the problems inherent in such plant, it should be pointed out that an ingot mould for casting steel billets has—with its ingot mould tube, its ingot mould body, its cooling circuit filled with cooling liquid and possibly an electromagnetic inductor to agitate the molten metal—a mass which is easily of the order of 3 tonnes. It is necessary to be able to confer on this mass oscillations with an amplitude of a few millimeters, and with a frequency of the order of 5 Hz and higher. It is hence necessary to use a device for generating mechanical oscillations which is very powerful, all the more so because this device has to overcome not only the inertia of the ingot mould itself, but also the inertia of the structure of the supporting structure as well as the frictional forces between the inner wall of the ingot mould tube and the molten metal. The high powers involved in producing the oscillations of the ingot mould have harmful effects such as noisy impacts and vibrations detrimental to the mechanical characteristics of certain elements of the ingot mould.

It has also been proposed to support the ingot mould in a support using springs, thus creating a damped harmonic oscillator whose mass corresponds to the mass of the ingot mould. In order to produce forced oscillations in such a mechanical system, it is sufficient to apply to the ingot mould a much smaller force, since it is possible to take advantage of the resonance phenomenon at the natural frequency of the system. In practice, the implementation of such a method may, however, pose problems of dimensioning and positioning of the springs. The latter must in effect support the great weight of the ingot mould while giving the system the required elastic characteristic.

The aim of the present invention is to propose an ingot mould which confronts the mechanical oscillation generating device with a considerably reduced mass.

This aim is achieved by an ingot mould for a continuous casting plant which comprises:

an ingot mould tube having an inner wall and an outer wall, the said inner wall defining an axial flow channel for a molten metal;

an ingot mould body surrounding the said outer wall of the ingot mould tube over at least part of its length so as to define with the latter a sealed chamber containing a circuit for cooling the ingot mould tube; and a device for generating mechanical oscillations, and which is characterised in that the ingot mould tube is movable axially with respect to the ingot mould body;

in that the ingot mould body is connected to the ingot mould tube by means of sealing elements allowing an axial movement of the ingot mould tube with respect to the ingot mould body, while providing for the sealing of the said sealed chamber; and in that the said device for generating mechanical oscillations is connected to the ingot mould tube so that it is capable of transmitting to the latter an axial oscillatory movement with respect to the ingot mould body.

In an ingot mould according to the invention, the mass in oscillatory motion is substantially reduced to the mass of the ingot mould tube. It will be appreciated that the mass of the ingot mould tube represents hardly more than 5% of the total mass of the ingot mould. The most massive elements of the ingot mould, i.e. the ingot mould body with its cooling circuit filled with cooling liquid and, if the case arises, the electromagnetic inductor, are stationary on a supporting framework and do not have to be set in motion by the mechanical oscillation generating device. The power involved in producing a relative oscillatory motion between the inner wall of the ingot mould tube and the peripheral crust of the cast product is thus considerably reduced. As a result of this, there is a reduction in the forces and vibrations that the continuous casting plant has to undergo; and hence there is an increase in the working life of some of its elements. In addition, the ingot mould body and the inductor, which no longer participate in the oscillatory motion, are no longer subjected to dynamic stresses, which also has a beneficial effect on their working life. It will also be appreciated that the absence of an oscillating supporting structure for the ingot mould considerably reduces the costs of investment and maintenance.

The ingot mould body is preferably designed so as to define at its upper and lower ends an opening forming a passage for the ingot mould tube; the sealing elements are then positioned in these two openings forming passages so as to delimit axially in the ingot mould body a sealed annular chamber capable of being pressurised by the cooling liquid. It is then advantageous to make the cross-sectional area of the upper opening forming a passage greater than the cross-sectional area of the lower opening forming a passage. This difference in cross-section gives rise in effect to a hydrostatic force on the ingot mould tube whose direction is opposite to that of the flow of molten metal. This hydrostatic force makes it possible to compensate for the weight of the ingot mould tube and the frictional force which the molten metal exerts on the inner wall of the ingot mould tube. It will then be appreciated that this method makes it possible to reduce still further the power required to produce the said oscillatory motion.

It is possible to provide, inside the ingot mould body, different types of circuit for cooling the ingot mould tube. In a preferred embodiment, the ingot mould body has an inner guide jacket which surrounds the ingot mould tube and forms with the latter a first annular space defining a first cross-section providing a passage for a cooling liquid. An outer jacket surrounds the said inner guide jacket and forms with the latter a second annular space, defining a second cross-section providing a passage for the cooling liquid which is considerably larger than the said first cross-section providing a passage.

In a first variant of the embodiment, the inner guide jacket is rigidly fixed to the outer wall of the ingot mould body and forms a jacket in which the ingot mould tube can slide axially.

This inner guide jacket, which has a relatively low weight, may however also form part of the ingot mould tube. In this case, it is set into oscillation together with the ingot mould tube.

The ingot mould tube advantageously comprises an inner tube, which defines the flow channel for the molten metal and which is most frequently a copper tube, and a cage which surrounds this copper tube. This cage is fixed rigidly and in a sealed manner at its upper end to the copper tube and has at its lower end a guide opening in which the copper tube is guided in a sealed manner so as to be able to expand axially downwards. The inner guide jacket for the cooling liquid is then supported by this cage surrounding the copper tube. The said sealing elements comprise lower sealing elements, which are connected between the lower end of the cage and the ingot mould body, and upper sealing elements, which are connected between the upper end of the cage and the ingot mould body. This is a method in which the masses in motion are slightly greater, but which has the significant advantage that the ingot mould tube and the inner guide jacket form a single fairly rigid unit. In addition, the ingot mould tube itself may expand freely in the axial direction.

Various embodiments are possible for the sealing elements. The latter may, for example, comprise an axial bellows expansion joint which is connected between a flange attached to the ingot mould tube and a flange attached to the ingot mould body. In a preferred embodiment, the sealing elements comprise at least one elastically deformable diaphragm. The latter is located in a plane transverse to the casting axis. This is a particularly simple embodiment which provides perfect sealing, requires absolutely no maintenance and makes it possible to produce a very compact construction for the ingot mould.

It turns out that a metal diaphragm with multiple sheets is perfectly suitable for the present use. However, this does not rule out the use of other materials to form the diaphragm, for example diaphragms made of a reinforced elastomer.

It would be possible to connect a device for generating axial mechanical oscillations directly to the ingot mould tube, i.e. without any intermediate linking mechanism. An advantageous method consists in providing a lever as a means of mechanical linkage between the mechanical oscillation generating device and the ingot mould tube. This linkage then has an intermediate hinged joint by means of which it is supported by the ingot mould body, a first lever arm connected to the mechanical oscillation generating device and a second lever arm supporting the ingot mould tube. This embodiment enables the mechanical oscillation generating device to be installed laterally alongside the ingot mould, where it causes absolutely no obstruction and where it can be protected against splashes of molten metal. Because the ingot mould tube is supported by the lever arm, itself supported by the ingot mould body, it is completely unnecessary to provide other means of support for the ingot mould tube. In particular, the said sealing elements do not have to fulfil the function of supporting the ingot mould tube in the ingot mould body.

The suspension of the ingot mould tube in the lever arm is preferably achieved by using two journals housed in a forked arm with two branches. A particularly compact embodiment of the ingot mould is obtained when the said intermediate hinged joint of the lever arm, the two journals and the second lever arm are located inside the said sealed chamber. The second lever arm should then pass in a sealed manner through the outer jacket of the ingot mould body.

The sealing between the second lever arm and the outer jacket of the ingot mould body is advantageously produced by means of a bellows expansion joint, which is preferably mounted inside the said sealed chamber. In connection with this, it will be appreciated that all the elements which are installed in this sealed chamber in the cooling liquid undergo a certain lubrication by the latter and are also less exposed to the risk of damage by the molten metal.

Leaf springs connected preferably between the ingot mould body and the ingot mould tube make it possible to guide the latter axially and avoid the sealing elements having to transmit transverse forces that are too great.

Additional advantages and characteristics of the invention will emerge from the detailed description of advantageous embodiments given below as illustrative examples, with reference to the appended drawings in which.

Figure 1:
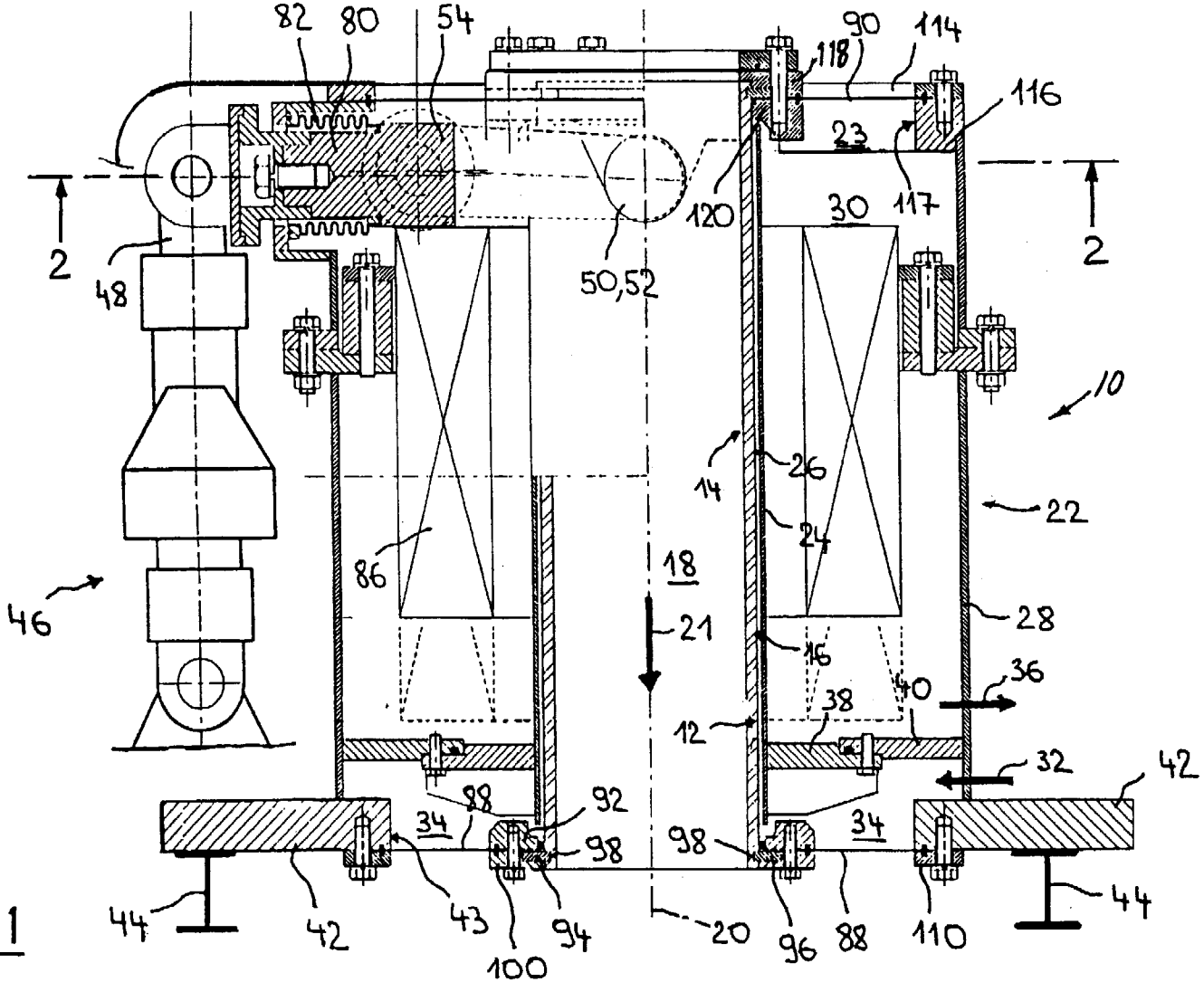
FIG. 1 represents a cross-section through an ingot mould according to the invention.
Figure 2:
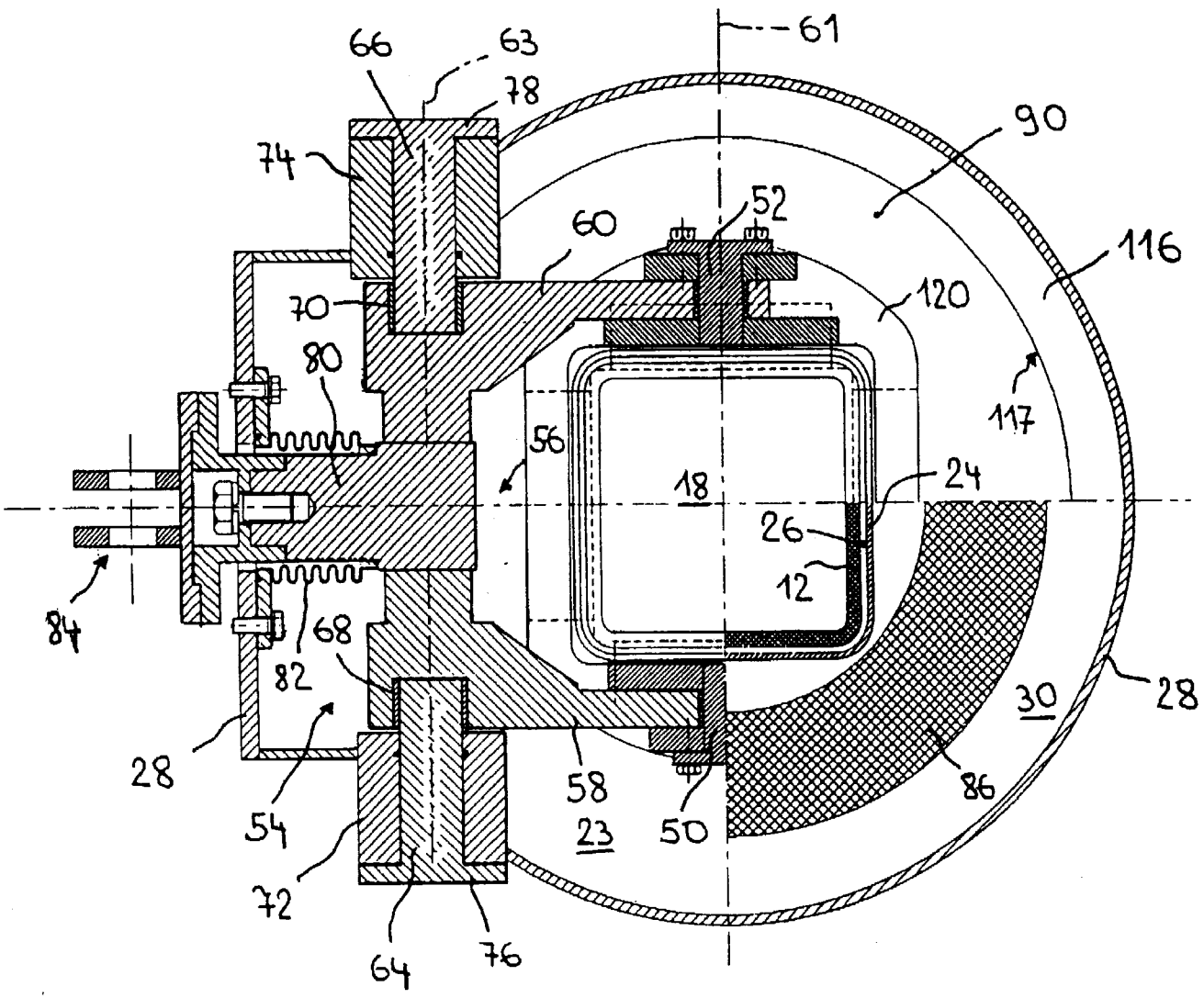
FIG. 2 represents a cross-section through the ingot mould of FIG. 1 along the sectional plane denoted by (2—2) in FIG. 1.

FIGS. 1 and 2 show an ingot mould 10 which may be used, for example, for the continuous casting of steel billets. It comprises an ingot mould tube 12 having an inner wall 14 and an outer wall 16. The inner wall 14 defines a flow channel 18 for the molten steel. The reference number 20 denotes the central axis of this channel, which may be straight or curved. Most frequently, the ingot mould tube is a thick-walled copper tube. The internal cross-section of this tube defines the cross-section of the cast product. A square cross-section is represented in FIG. 2; this cross-section could however also be rectangular, circular or could have any other shape. The arrow denoted by the reference number 21 indicates the direction of flow of the molten steel through the ingot mould tube 12.

The ingot mould tube 12 must be cooled vigorously in order to bring about a solidification of the molten steel in contact with its inner wall 14. For this purpose, it is surrounded, usually over its whole height, by an ingot mould body 22 which contains, in a sealed chamber 23, a circuit for cooling the outer wall 16 of the ingot mould tube 12.

The cooling circuit represented in FIG. 1 is known per se. An inner guide jacket 24 surrounds the ingot mould tube 12 over almost the whole of its height and forms, around the outer wall 16 of the ingot mould tube 12, a first annular space 26, providing a channel with a very narrow annular cross-section. An outer jacket 28 of the ingot mould body 22 surrounds the inner guide jacket 24 and forms, with the latter, a second annular space 30, which surrounds the first annular space 26 and defines a channel with a significantly greater annular cross-section. A circuit for the supply of the cooling liquid is represented schematically by the arrow 32. The cooling liquid enters through an annular supply chamber 34, located alongside the lower end of the ingot mould 10, and passes into the first annular space 26. It passes through the latter at high speed and flows in a direction opposite to the casting direction 21, emerging into the second annular space 30. It is evacuated outside the ingot mould body 22 by a drainage circuit which is itself represented schematically by the arrow 36. It only remains to note in this connection that the inner guide jacket 24 is fitted with an outer flange 38 which is fixed in a sealed manner to an inner mating flange 40 of the outer jacket 28. In this way, the inner guide jacket 24 is supported rigidly by the outer jacket 28 of the ingot mould body 22, and the annular supply chamber 34 is at the same time separated in a sealed manner from the said second annular space 30.

It can be seen in FIG. 1 that the ingot mould body 22 is fitted at its lower end with a peripheral base 42 which defines an opening 43 for the passage of the ingot mould tube 12. With this lower peripheral base 42, the ingot mould body rests on a fixed supporting framework represented schematically by two girders denoted by the reference number 44.

A mechanical oscillation generating device 46 is supported on the supporting framework alongside the ingot mould body 22 (the support for the mechanical oscillation generating device 46 on the supporting framework 44 is not represented in FIG. 1). This device is, for example, a hydraulic piston equipped with a hydraulic circuit known per se, which is suitable for communicating to a piston rod 48 a reciprocating motion with an amplitude of a few millimeters and a frequency of a few hertz. It could however also be a rotary motor fitted with an eccentric which produces the mechanical oscillations. In that case, the piston rod 48 would be replaced by a connecting rod. The hydraulic piston does however have the advantage of allowing easy and flexible adjustment of the amplitude, frequency and form of the mechanical oscillations produced.

It can be seen in FIG. 2 that the ingot mould tube 12 is fitted at its upper end with two journals 50 and 52. The latter are positioned on two opposite sides of the outer wall 16 of the ingot mould tube 12, so that their axes are aligned and perpendicular to the axis 20 of the ingot mould tube 12. With the help of these journals 50 and 52, the ingot mould tube is supported by a forked arm 56. The two journals 50, 52 are, more precisely, hinged respectively in a first branch 58 and a second branch 60 of the forked arm 56 so as to define a pivoting axis 61 for the ingot mould tube 12 which is perpendicular to the casting direction. It is to be noted that the two journals 50, 52 are located in the said second annular space 30 defined between the inner guide jacket 24 on one side and the outer jacket 28 on the other side.

The forked arm 56 forms part of a lever 54 mounted in the ingot mould body 22. This lever 54 has, in the second annular space 30, a tilting axis 63 which is parallel to the pivoting axis 61 of the ingot mould tube 12. This tilting axis 63 is advantageously brought into being by two pivots 64 and 66 which are mounted symmetrically on the ingot mould body 22. Each of the branches 58, 60 of the forked arm 56 is then fitted with a cylindrical housing 68, 70 for one of the two pivots 64, 66. It is to be noted that each of the pivots 64, 66 may be fitted from outside the ingot mould body 22, in order to allow easy installation and removal of the lever 54. For this purpose, the outer jacket 28 of the ingot mould body 22 is fitted with two supporting blocks 72, 74 in which the pivots 64 and 66 are housed in a hole drilled for their passage. Each pivot 64, 66 is fitted with a mounting flange 76, 78 which is attached with screws (not represented) to the supporting block 72, 74. A seal between the flange 76, 78 and the supporting block 72, 74, preferably together with one or more O-rings in the hole drilled for the passage of the pivots in the supporting block 72, 74, ensures that this mounting is sealed.

On the opposite side of the forked arm 56, the lever 54 has a second lever arm 80 which passes in a sealed manner through the outer jacket 28 of the ingot mould body 22. This sealed passage is preferably produced by means of a bellows expansion joint 82, which is connected in a sealed manner with its first end to the outer jacket 28 of the ingot mould body 22 and with its second end to a shoulder on the second lever arm 80.

Outside the second annular space 30, preferably in the immediate neighbourhood of the outer jacket 28 of the ingot mould body 22, the second lever arm 80 is connected by means of a cylindrical hinged joint 84, with axis parallel to the tilting axis 63 of the lever 54, to the piston rod 48. It is to be noted that the two journals 50, 52, the forked arm 56, the tilting axis 63, the greater part of the second lever arm 80 and the bellows expansion joint 82 are incorporated into the second annular space 30. This embodiment not only enables the ingot mould 10 to be made compact but also provides for effective protection of these elements. It is also to be noted that all these elements are submerged in the cooling liquid, which provides a certain amount of lubrication for the hinged joints.

The reciprocating motion of the piston rod 48 is transmitted by the lever 54 to the ingot mould tube 12. The latter is mounted in the ingot mould body 22 and connected to the latter so as to be able to follow the oscillatory movement of the lever 54. As a result of this, the ingot mould tube 12 is subjected to a forced oscillatory movement with respect to the ingot mould body 22, which remains stationary. The mass in motion therefore corresponds to the mass of the ingot mould tube 12, which is generally at least 20 times smaller than the total mass of the ingot mould, which includes, apart from the ingot mould tube 12, the ingot mould body 22 filled with a cooling liquid and possibly an electromagnetic inductor 86. The latter, which serves to agitate the molten steel, is incorporated in a way known per se in the said second annular space 30 of the ingot mould body 22, in which it is supported by the outer jacket 28 of the ingot mould body 22. This inductor 86 itself is therefore also stationary with respect to the ingot mould tube which is subjected to the oscillatory movement.

The outer jacket 28 is connected in a sealed manner, at its two axial ends, to the outer wall 16 of the ingot mould body 22 by means of sealing elements which allow an axial displacement of the ingot mould tube 12 with respect to the ingot mould body 22. These sealing elements preferably consist of a lower diaphragm 88, delimiting the said sealed chamber 23 of the ingot mould body 22 axially at its lower end, and an upper diaphragm 90, delimiting it axially at its upper end. The diaphragms are annular diaphragms contained in a plane transverse to the casting axis and elastically deformable in a direction perpendicular to their surface. Metal diaphragms with multiple sheets may, for example, be suitable for such use.

In FIG. 1, it can be seen that the lower annular diaphragm 88 is connected on one side with its outer peripheral edge to the peripheral base 42 of the ingot mould body 22, and on the other side with its inner edge to a lower flange 92. The latter is attached to the lower end of the ingot mould tube 12 by means of pins 94, 96, which are seated in a groove 98 in the ingot mould tube 12. The pins 94 and 96, and the inner edge of the lower diaphragm 88, are fixed by clamping between the flange 92 and a mating flange 100, which is fixed by screws to the flange 92. Sealing gaskets provide the sealing for this assembly. The outer edge of the diaphragm 88 is fixed by clamping between the peripheral base 42 and a mating flange 110. Sealing gaskets provide the sealing between the diaphragm 88 and the peripheral base 42 and mating flange 110 respectively. The upper diaphragm 90 is mounted in a similar way. A mating flange 114 fixes the outer edge of the upper diaphragm 90 to an upper ring 116 attached to the outer jacket 28 of the ingot mould body 22. This upper ring 116 defines an upper opening 117 for the passage of the ingot mould tube 12. A mating flange 118 fixes the inner edge of the upper diaphragm 90 to an upper flange 120 of the ingot mould tube 12. The upper flange 120 is attached to the upper end of the ingot mould tube 12 in the same way as the lower flange 92. The two journals 50 and 52 are also advantageously supported by the said upper flange 120 (cf. FIG. 1).

It is to be noted that it is advantageous to provide the lower opening forming a passage 43, defined by the lower base 42, with a transverse (or projected) cross-section smaller than that of the upper opening forming a passage 117 defined by the upper ring 116. During the pressurising of the sealed chamber 23, a hydrostatic force results, which is applied to the ingot mould tube 12 in a direction opposite to the casting direction 21. Since the pressure prevailing respectively inside the annular supply chamber 34 and inside the second annular space 30 is of the order of a few bars, a difference of a few centimeters between the inner diameter of the upper ring 116 and the inner diameter of the lower base 42 is sufficient for the said hydrostatic force to compensate both for the weight of the ingot mould tube 12 and the frictional force that the cast metal exerts on the inner wall 14 of the ingot mould tube 12. As a result of this, the forces required to make the ingot mould tube 12 oscillate with respect to the ingot mould body 22 are almost reduced to the forces required to deform the diaphragms 88 and 90 and to overcome the frictional force between the inner wall 14 of the ingot mould tube 12 and the cast product due mainly to the displacement of the ingot mould tube 12.

Figure 3:
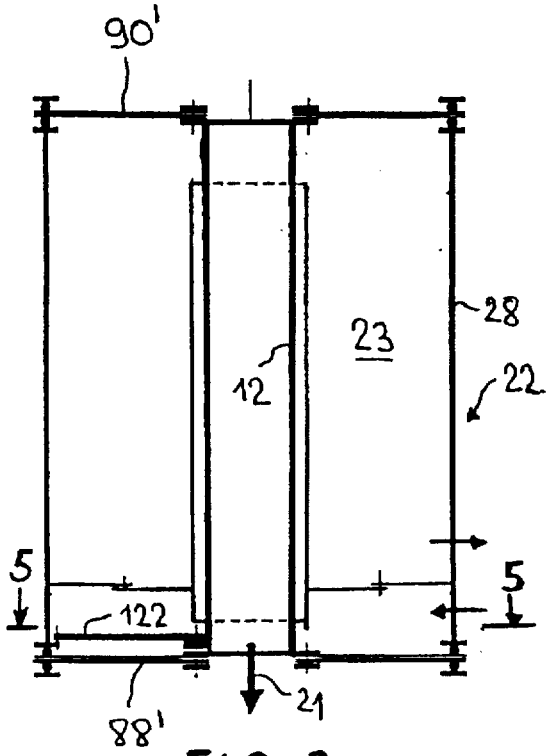
FIGS. 3 and 4 are schematic representations, in longitudinal sections, of details of two different embodiments of an ingot mould according to the invention.
Figure 4:
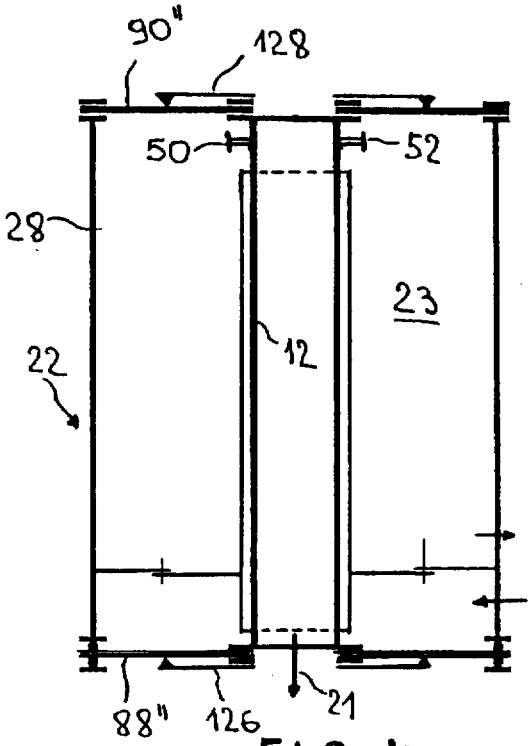
Figure 5:
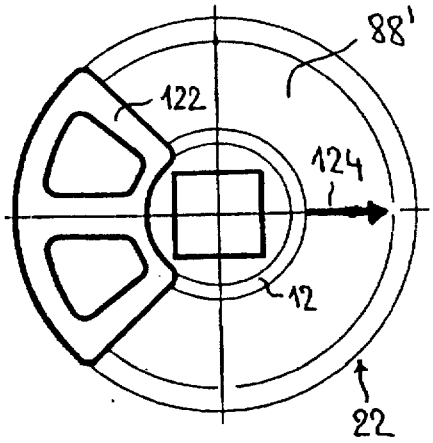
FIG. 5 represents a cross-section through the ingot mould of FIG. 3 along the sectional plane (5—5)

FIGS. 3 to 5 provide additional information about the mounting of the annular diaphragms. It can be seen in FIG. 3 that the lower and upper diaphragms 88' and 90' are both embedded by their inner edges at the level of the ingot mould tube 12, while their outer edges may be slightly displaced between the base 42 (respectively 116) and the mating flange 110 (respectively 114). This method of fixing the diaphragms 88' and 90' increases their flexibility and reduces the transverse forces they have to transmit from the ingot mould tube 12 to the ingot mould body 22. For the transmission of these transverse forces, distinct elements are preferably used, for example one or more leaf springs connected between the ingot mould tube 12 and the ingot mould body 22. FIG. 5 represents, as an example, such a leaf spring 122, which has three branches spaced apart by 45°. This element 122 can easily be deformed in a direction perpendicular to the plane of the drawing and at the same time has a high resistance to a tractive force. It is preferably mounted alongside the lower end of the ingot mould tube 12, because the upper end is already rigidly supported in the forked arm 56 of the lever arm 54. In addition, this element 122 is mounted so as to be stressed in traction. The arrow 124 in FIG. 5 represents, as an example, the horizontal component of the tractive force which the cast product extracted from the ingot mould tube 12 exerts on the lower end of the latter. This force, which is far from being negligible, is transmitted by the element 122 from the ingot mould tube 12 to the ingot mould body 22; the diaphragm 88' is in no way involved in this transmission.

In the case in which the axis of the ingot mould defines an arc of a circle, it is advantageous to orient the element 122 so that the prolongation of its neutral axis passes through the centre of curvature of this arc of a circle. The pivoting axis 61 of the ingot mould tube 12 in the forked arm 56, the tilting axis 63 of the lever 54 and the axis of the cylindrical joint 84 are in this case positioned so that they are all three cut by a straight line also passing through the said centre of curvature. As a result of this, the ingot mould tube performs its oscillations along a path which substantially matches the curvature of the cast product at the level of the ingot mould tube.

It can be seen in FIG. 4 that the upper diaphragm 90" is embedded by both its two edges. This does not cause any major disadvantage, because the upper end of the ingot mould tube 12 transmits transverse forces through the journals 50, 52 directly to the lever 54 (cf. FIG. 2). Also represented schematically in the same FIG. 4 are annular elements 126, 128 for supporting the diaphragms 88" and 90". The purpose of these supporting elements 126 and 128, which are for example attached to the ingot mould tube 12, is to limit the deformation of the diaphragms 88" and 90" due to the pressure of the cooling liquid in the sealed chamber 23.

Figure 6:
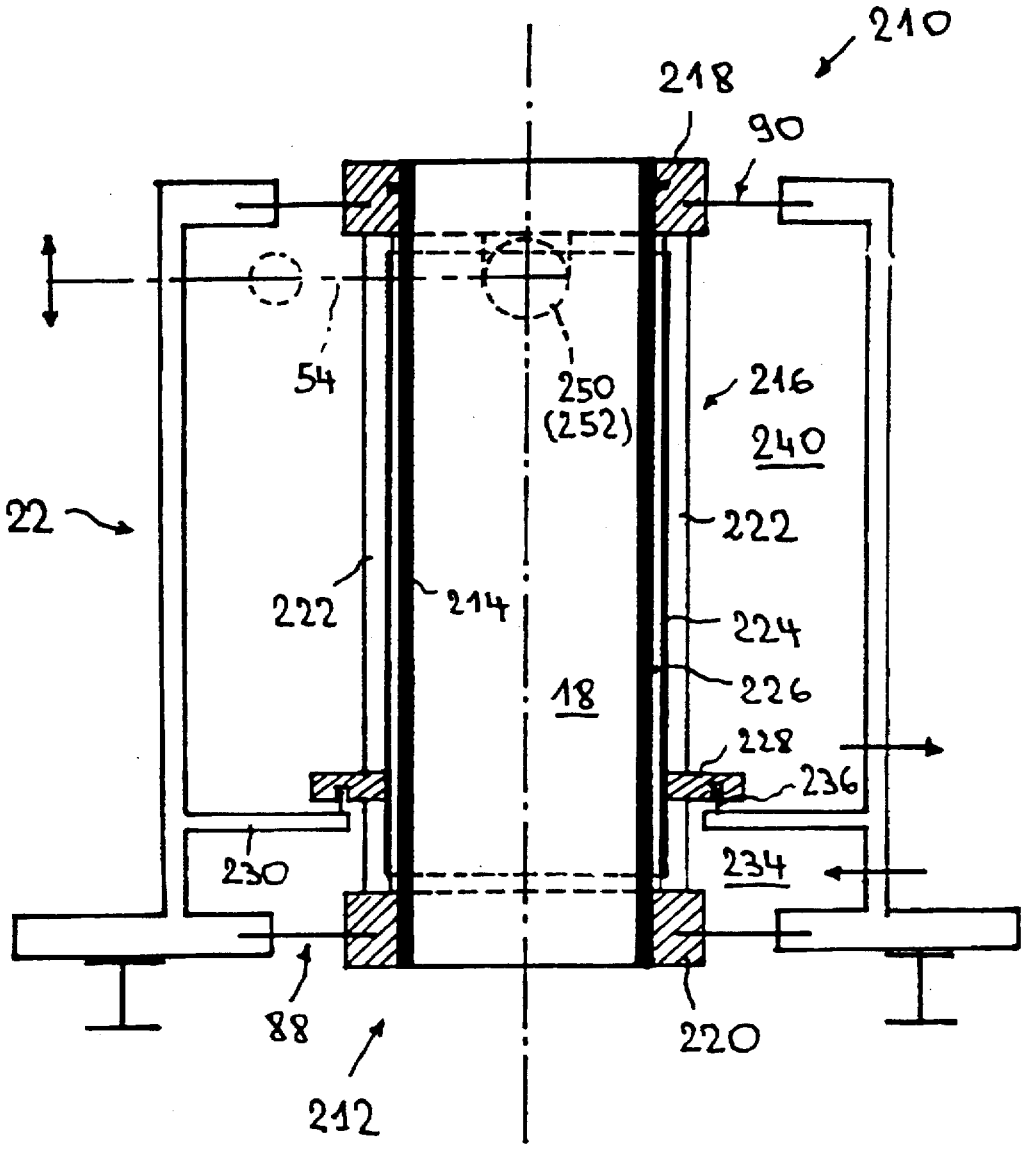
FIG. 6 represents a schematic cross-section through a variant of the embodiment of the invention.

FIG. 6 represents a particularly attractive variant of the embodiment of an ingot mould 210 according to the invention. An ingot mould tube 212 comprises a copper tube 214 defining an axial flow channel 18 for the molten metal. In this variant of the embodiment, the copper tube 214 is surrounded by a cage 216. The latter comprises stiffening elements 222 connecting an upper flange 218 and a lower flange 220. The upper flange 218 is attached rigidly to the upper end of the copper tube 214. The lower flange 220 surrounds the copper tube 214 in a sealed manner but is not fixed rigidly to it. As a result of this, the copper tube 214 can expand axially through the flange 220 when it undergoes thermal expansion. A sealed joint, for example a VITON® joint or an O-ring resistant to high temperatures, provides the sealing between the lower flange 220 and the copper tube 214.

The cage 216 supports a guide jacket 224 which defines an annular space providing a narrow passage 226 for the cooling liquid around the copper tube 214. This guide jacket 224 is fitted with a collar 228 which cooperates with an annular dividing wall 230 of the ingot mould body 22 in order to delimit in the ingot mould 210 an annular supply chamber 234 of the annular space 226. It is to be noted that the collar 228 and the dividing wall 230 are connected to each other by a sealing element 236 which must allow their relative displacement along the casting axis. In a preferred embodiment, the sealing element 236 comprises a ring which is fixed in a sealed manner to the dividing wall 230 and which defines a labyrinth gland in an annular cavity of the collar 228. This labyrinth gland could, if really necessary, be replaced by one or more O-rings.

An upper sealing diaphragm 90 and a lower sealing diaphragm 88 connect the upper and lower flanges 218 and 220 respectively to the ingot mould body 22. It is to be noted that, in the embodiment of FIG. 6, the outer and inner edges of the two diaphragms 90, 88 are rigidly embedded. The methods of fixing the diaphragms described using FIGS. 3 and 4 of course remain valid alternatives.

The copper tube 214, the cage 216 and the guide jacket for the cooling liquid 224 define, in the embodiment according to FIG. 6, a fairly rigid assembly, which is axially displaceable as a whole with respect to the ingot mould body 22. This assembly is supported by a lever arm 254 (represented in FIG. 6 by its axis) using two journals 250, 252, which form part of the upper flange 218.

It remains to note that, in the embodiment of FIG. 6, the cooling liquid enters the annular supply chamber 234, passes at high speed through the narrow annular space 226, where it undergoes a considerable head loss, and emerges from the ingot mould after having passed through the annular space 240, which may for example house an electromagnetic agitator (not represented). Because the pressure in the annular supply chamber 234 is higher than the pressure in the annular chamber 240, the hydrostatic pressure exerted on the collar 228 helps in supporting the assembly consisting of the copper tube 214, the cage 216 and the guide jacket for the cooling liquid 224.

Although an embodiment according to FIG. 6 has the drawback that the mass to be set into oscillation is slightly greater, it nevertheless has the advantage that the copper tube 214 is less mechanically stressed than the copper tube 14.

We claim:

1. In an apparatus which including an ingot mould for a continuous casting plant comprising:

an ingot mould tube (12) having an inner wall (14) and an outer wall (16), the said inner wall (14) defining an axial flow channel (18) for a molten metal;

an ingot mould body (22) surrounding the said outer wall (16) of the ingot mould tube (12) over at least part of its length so as to define with the latter a sealed chamber (23) containing a circuit for cooling the ingot mould tube (12); and a device for generating mechanical oscillations (46), characterised in that the ingot mould tube (12) is movable axially with respect to the ingot mould body (22);

in that the ingot mould body (22) is connected to the ingot mould tube (12) by means of sealing elements (88, 90) allowing an axial movement of the ingot mould tube (12) with respect to the ingot mould body (22), while providing for the sealing of the said sealed chamber (23); and in that the said device for generating mechanical oscillations (46) is connected to the ingot mould tube (12) so that it is capable of transmitting to the latter an axial oscillatory movement with respect to the ingot mould body (22).

2. Ingot mould according to claim 1, characterised in that the ingot mould body (22) comprises an upper opening (117) and a lower opening (43) forming passages for the ingot mould tube (12), in that the said sealing elements (88, 90) are positioned in these two openings forming passages (43, 117) so as to delimit in the ingot mould body (22) around the ingot mould tube (12) a sealed annular chamber (23) capable of being pressurised by a cooling liquid, in that the cross-sectional area of the upper opening forming a passage (117) is greater than the cross-sectional area of the lower opening forming a passage (43) so that there results from this a hydrostatic force on the ingot mould tube (12) whose direction is opposite to that of the flow of molten metal.

3. Ingot mould according to claim 1, characterised in that the ingot mould body (22) has an inner guide jacket (24), which surrounds the ingot mould tube (12) and forms with the latter a first annular space (26) defining a first cross-section providing a passage for a cooling liquid, and an outer jacket (28), which surrounds the said inner guide jacket (24) and forms with the latter a second annular space (30) defining a second cross-section providing a passage for the cooling liquid which is considerably larger than the said first cross-section providing a passage.

4. Ingot mould according to claim 3, characterised in that the inner guide jacket (24) is rigidly fixed to the ingot mould body (22).

5. Ingot mould according to claim 3, characterised in that the inner guide jacket (224) forms part of the ingot mould tube (212).

6. Ingot mould according to claim 5, characterised in that the ingot mould tube (212) comprises a copper tube (214) defining the said axial flow channel (18) for the molten metal, and a cage (216) which extends along the copper tube (214) and which is fixed rigidly and in a sealed manner at its upper end to the copper tube (214), in that this cage (216) has at its lower end a guide opening in which the copper tube (214) is guided in a sealed manner so as to be able to expand axially downwards, and in that a guide jacket for the cooling liquid (224) is supported by this cage (216).

7. Ingot mould according to claim 6, characterised in that the said sealing elements (88, 90) comprise lower sealing elements (88) connected between the lower end of the cage (216) and the ingot mould body (22), and upper sealing elements (90) connected between the upper end of the cage (216) and the ingot mould body (22).

8. Ingot mould according to claim 6, characterised in that the cage (216) is fitted with a collar (228), in that the ingot mould body 22 is fitted with an annular dividing wall (230), in that the collar (228) and the annular dividing wall (230) delimit in the ingot mould (210) an annular supply chamber (234) for a cooling liquid, and in that the collar (228) and the annular dividing wall (230) are connected by a sealing element (236) which allows their relative displacement along the casting axis.

9. Ingot mould according to claim 1, characterised in that the said sealing elements comprise at least one elastically deformable diaphragm (88, 90).

10. Ingot mould according to claim 9, characterised in that the diaphragm (88, 90) is a metal diaphragm with multiple sheets.

11. Ingot mould according to claim 1, characterised by a lever (54) fitted with an intermediate hinged joint (63) by means of which it is supported by the ingot mould body (22), the said lever (54) comprising a first lever arm (56) supporting the ingot mould tube (12) at its upper end and a second lever arm (80) connected to the mechanical oscillation generating device (46).

12. Ingot mould according to claim 11, characterised in that the ingot mould tube (12) is fitted at its upper end with two journals (50, 52); and in that the said first lever arm (56) is a forked arm with two branches (58, 60), each of the journals (50, 52) being supported by one of these branches (58, 60).

13. Ingot mould according to claim 3, characterised in that the said intermediate hinged joint (63) of the lever arm, the two journals (50, 52) and the first lever arm (56) are located inside the said sealed annular chamber (23), and in that the said second lever arm (80) passes through the said outer jacket (28) of the ingot mould body (22), and is connected to the latter in a sealed manner by means of a bellows expansion joint (82).

14. Ingot mould according to claim 1, characterised in that the said sealed chamber (23) contains an electromagnetic inductor (86) which is supported by the ingot mould body (22).

15. Ingot mould body according to claim 1, characterised in that the mechanical oscillation generating device (46) is a hydraulic piston.

16. Ingot mould according to claim 1, characterised by leaf springs (122) connected between the ingot mould tube (12) and the ingot mould body (22).

* * * * *